US009358558B2

(12) United States Patent
Kosaka et al.

(10) Patent No.: US 9,358,558 B2
(45) **Date of Patent: *Jun. 7, 2016**

(54) SPRAY GUN

(71) Applicant: ANEST IWATA CORPORATION, Yokohama-shi, Kanagawa (JP)

(72) Inventors: Shozo Kosaka, Yokohama (JP); Masaru Kaneko, Fujisawa (JP); Nobuyoshi Morita, Yokohama (JP); Takayuki Hata, Yokohama (JP); Atsushi Morohoshi, Yokohama (JP); Nobuhiro Sawata, Yokohama (JP)

(73) Assignee: ANEST IWATA CORPORATION, Yokohama (JP)

( * ) Notice: Subject to any disclaimer, the term of this patent is extended or adjusted under 35 U.S.C. 154(b) by 176 days.

This patent is subject to a terminal disclaimer.

(21) Appl. No.: 13/687,402

(22) Filed: Nov. 28, 2012

(65) Prior Publication Data

US 2014/0042247 A1 Feb. 13, 2014

(30) Foreign Application Priority Data

Aug. 8, 2012 (JP) ..... 2012-176150

(51) Int. Cl.
*B05B 1/26* (2006.01)
*B05B 7/06* (2006.01)
*B05B 7/08* (2006.01)

(52) U.S. Cl.
CPC . *B05B 7/066* (2013.01); *B05B 7/06* (2013.01); *B05B 7/0815* (2013.01); *B05B 7/0861* (2013.01)

(58) Field of Classification Search
CPC ..... B05B 7/06; B05B 7/062; B05B 7/066; B05B 7/12; B05B 7/0815; B05B 7/0861
USPC ..... 239/292, 296–301, 407, 408, 413–415, 239/416, 416.4–417.5, 418, 420, 239/423–424.5, 526
See application file for complete search history.

(56) References Cited

U.S. PATENT DOCUMENTS 1,751,787 A * 3/1930 Binks ..... 239/299
2,646,314 A 7/1953 Peeps (Continued)

FOREIGN PATENT DOCUMENTS

EP 0 092 392 A2 10/1983
EP 0 650 766 B1 4/1999

(Continued)

OTHER PUBLICATIONS

Jul. 24, 2013 Declaration of Robert R. Lacovara Exhibit 2002 in IPR2013-00111.

(Continued)

*Primary Examiner* — Christopher Kim
(74) *Attorney, Agent, or Firm* — Oliff PLC

(57) ABSTRACT

Disclosed is a spray gun including: a body having a gun barrel; a coating material nozzle disposed on a tip end side of the gun barrel, and an air cap disposed on the tip end side of the gun barrel to surround a tip end portion of the coating material nozzle, wherein the tip end portion of the coating material nozzle has on the tip end surface thereof a guide wall spreading, and also has on the outer peripheral surface thereof a plurality of air grooves channeled in a longitudinal direction, and wherein each of the air grooves has a bottom portion gradually increasing in depth in the longitudinal direction, the bottom portion being located within a range of the guide wall on the tip end surface of the coating material nozzle.

9 Claims, 7 Drawing Sheets

(56) References Cited

U.S. PATENT DOCUMENTS

| | | | | |
|---|---|---|---|---|
| 3,583,632 | A | 6/1971 | Shaffer et al. | |
| 3,746,253 | A | 7/1973 | Walberg | |
| 3,747,850 | A | 7/1973 | Hastings et al. | |
| 3,857,511 | A | 12/1974 | Govindan | |
| 3,873,023 | A | 3/1975 | Moss et al. | |
| 4,273,293 | A | 6/1981 | Hastings | |
| 4,884,742 | A | 12/1989 | Bekius et al. | |
| 5,064,119 | A | 11/1991 | Mellette | |
| 5,078,323 | A | 1/1992 | Frank | |
| 5,080,285 | A | 1/1992 | Toth | |
| 5,088,648 | A | 2/1992 | Schmon | |
| 5,090,623 | A | 2/1992 | Burns et al. | |
| 5,249,746 | A | 10/1993 | Kaneko et al. | |
| 5,344,078 | A | 9/1994 | Fritz et al. | |
| 5,435,491 | A | 7/1995 | Sakuma | |
| 5,456,414 | A | 10/1995 | Burns et al. | |
| 5,540,385 | A | 7/1996 | Garlick | |
| 5,607,108 | A | 3/1997 | Garlick et al. | |
| 5,613,637 | A | 3/1997 | Schmon | |
| 5,941,461 | A | 8/1999 | Akin et al. | |
| 5,992,763 | A | 11/1999 | Smith et al. | |
| 6,494,387 | B1 * | 12/2002 | Kaneko | 239/296 |
| 6,708,900 | B1 | 3/2004 | Zhu et al. | |
| 7,163,160 | B2 | 1/2007 | Liu | |
| 8,225,892 | B2 | 7/2012 | Ben-Tzvi | |
| 2005/0145718 | A1 | 7/2005 | Blette et al. | |

FOREIGN PATENT DOCUMENTS

| | | | |
|---|---|---|---|
| EP | 0 650 766 B1 | B1 | 4/1999 |
| JP | S58-119862 | U | 8/1983 |
| JP | S61-55951 | U | 4/1986 |
| JP | H01-77863 | U | 5/1989 |
| JP | H06-304501 | A | 11/1994 |
| JP | A-8-196950 | | 8/1996 |
| JP | 2002-001169 | A | 1/2002 |
| JP | 2010-502419 | A | 1/2010 |
| WO | WO 01/02099 | A1 | 1/2001 |
| WO | 2008/029229 | A1 | 3/2008 |

OTHER PUBLICATIONS

Sep. 25, 2013 Proposed Amendment in IPR2013-00111.
Dec. 18, 2013 Fig. 2 of EX1020 p. 13 marked up by witness Lacovara, Exhibit 2008 in IPR2013-00111.
Jan.-Mar. 2009 SATA News, Exhibit 2010 in IPR2013-00111.
SATA Dan-Am Air with Tony Larimer—YouTube, http://www.youtube.com/watch?v=iJtAGIAmSB0 obtained Oct. 9, 2013, Exhibit 2011 in IPR2013-00111.
Sata Spray Guns and Airbrush, http://www.myrideisme.com/Blog/sata-auto-paint-guns-sema/ obtained Oct. 9, 2013, Exhibit 2012 in IPR2013-00111.
How to Set Air Pressure Air Volume—YouTube, http://www.youtube.com/watch?v=HDuuJvyiZi1 obtained Oct. 9, 2013, Exhibit 2013 in IPR2013-00111.
Ohio EPA Letter to Tony Larimer submitted Nov. 11, 2013, Exhibit 2014 in IPR2013-00111.
Ben-Tzvi, Pinhas et al. "A Conceptual Design and FE Analysis of a Piezoceramic Actuated Dispensing System for Microdrops Generation in Microarray Applications". ScienceDirect (2007), Exhibit 2015 in IPR2013-00111.
Printout from Internet, http://www.amazon.com/Dispensing-Microdrops-Generation-Medical-A . . . obtained Oct. 14, 2013, Exhibit 2017 in IPR2013-00111.
Rone, William S. et al. "MEMS-Based Microdroplet Generation with Integrated Sensing". Excerpt from the Proceedings of the 2011 COMSOL Conference in Boston, Exhibit 2018 in IPR2013-00111.
Oct. 11, 2013 Larimer Deposition, Exhibit 2021 in IPR2013-00111.
Oct. 14, 2013 Schmon Deposition, Exhibit 2022 in IPR2013-00111.
Oct. 15, 2013 BenTzvi Deposition, Exhibit 2023 in IPR2013-00111.
Oct. 17, 2013 Akafuah Deposition, Exhibit 2024 in IPR2013-00111.
Certified translation of JP 8-196950 (Exhibit 1020 in IPR2013-00111).
Oct.-Dec. 1996 SATA News Publication Dan-Am, Exhibit 1035 in IPR2013-00111.
Dec. 9, 2013 Demonstrative 1, Substitute Claim 23, Exhibit 2025 from IPR2013-00111.
Dec. 9, 2013 Demonstrative 2, From pp. 44-46 of the transcript of the deposition of Nelson Akafuah, Exhibit 2026 in IPR2013-00111.
Printout from Internet http://www.alsacorp.com/products/hvlp-sprayguns/obtained Aug. 26, 2012, Exhibit 1026 in IPR2013-00111.
Jan. 11, 2013 Petition for Inter Partes Review in IPR2013-00111.
Apr. 10, 2013 Preliminary Response in IPR2013-00111.
May 23, 2013 Decision in IPR2013-00111.
Jun. 6, 2013 Petitioner's Request for Rehearing in IPR2013-00111.
Jun. 25, 2013 Decision on Rehearing in IPR2013-00111.
Jul. 25, 2013 Motion to Amend in IPR2013-00111.
Aug. 8, 2013 Motion to Amend (updated) in IPR2013-00111.
Sep. 30, 2013 Petitioner's Opposition in IPR2013-00111.
Oct. 21, 2013 Reply in IPR2013-00111.
Nov. 11, 2013 Motion to Exclude Evidence in IPR2013-00111.
Nov. 25, 2013 Petitioner's Opposition in IPR2013-00111.
Dec. 2, 2013 Reply to Petitioner's Opposition in IPR2013-00111.
Apr. 9, 2014 Oral Hearing Transcript in IPR2013-00111.
May 20, 2014 Final Written Decision in IPR2013-00111.
Jan. 24, 2013 First drawing based on Fig.2 of JP 8-196950, Exhibit 1003 in IPR2013-00111.
Jan. 24, 2013 Second drawing based on Fig. 2 of JP 8-196950, Exhibit 1004 in IPR2013-00111.
Jan. 24, 2013 Third drawing based on Fig 2 of JP 8-196950, Exhibit 1005 in IPR2013-00111.
Printout from Internet http://www.ehow.com/how_4493101_choose-spray-gun-auto-paint.html obtained Sep. 7, 2012, Exhibit 1023 in IPR2013-00111.
Printout from Internet http://www.bodyshopbusiness.com/Article/3512/common_sense_spraygun_tips.aspx obtained Sep. 7, 2012, Exhibit 1024 in IPR2013-00111.
Printout from Internet Brochure of Walther Pilot, www.walther-pilot.de published Mar. 2007, Exhibit 1025 in IPR2013-00111.
Printout from Internet http://www.alsacorp.com/products/hvlp-sprayguns/ obtained Aug. 26, 2012, Exhibit 1026 in IPR2013-00111.
Printout from Internet p. 28 from current 3M brochure, http://homesteadfinishingproducts.com/wp-content/uploads/2014/04/34-8701-7283-9-Automatic-Gun-Manual.pdf (2008), Exhibit 1027 in IPR2013-00111.
Sep. 5, 2012 Declaration of Knud Jorgensen, Exhibit 1028 in IPR2013-00111.
Apr. 12, 2012 decision by EPO, Exhibit 1029 in IPR2013-00111.
May 5, 2005 claims in issue in the Opp Proceeding of Exhibit 1029, Exhibit 1030 in IPR2013-00111.
Jan. 24, 2013 Prior art statement showing state-of-the-art in mid 1990s, Exhibit 1031 in IPR2013-00111.
Jul.-Sep. 1996 SATA News Publication Dan-Am, Exhibit 1034 in IPR2013-00111.
Apr.-Jun. 1998 SATA News Publication Dan-Am, Exhibit 1036 in IPR2013-00111.
1991 Dan-Am SATA Catalog 6 for spray guns, Exhibit 1037 in IPR2013-00111.
1994 Dan-Am SATA Catalog 8 for spray guns, Exhibit 1038 in IPR2013-00111.
1991 Dan-Am Catalog pp. 6-51, Exhibit 1042 in IPR2013-00111.
Mar. 1, 1991 JIS B 9809 English translation, Exhibit 1049 in IPR2013-00111.
Mar. 1, 1991 JIS B 9809, Exhibit 1050 in IPR2013-00111.
SATA LM 92 blueprints, SATA Gmbh (1984, 1986, 1990, 1992), Exhibit 1055 in IPR2013-00111.
SATAjet K, SATA Gmbh (1987, 1991, 1992), Exhibit 1056 in IPR2013-00111.
SATA NR 95, SATA Gmbh (1994, 1996), Exhibit 1057 in IPR2013-00111.
SATAjet 90, SATA Gmbh (1989, 1994, 1995, 1996, 1997), Exhibit 1058 in IPR2013-00111.
SATA GRZ, SATA Gmbh (1987, 1992), Exhibit 1059 in IPR2013-00111.

(56) References Cited

OTHER PUBLICATIONS

SATAjet B, SATA Gmbh (1980, 1987, 1991, 1992), Exhibit 1060 in IPR2013-00111.
SATAjet H, SATA Gmbh (1983, 1987, 1991), Exhibit 1061 in IPR2013-00111.
Enlarged view of table on p. 4 of SATAjet H (NPL 41), SATA Gmbh (1987), Exhibit 1062 in IPR2013-00111.
Jan. 1, 1995 SATA Gmbh Price list, Exhibit 1063 in IPR2013-00111.
Twist nozzle set with translation and certificate (1973, 1976), Exhibit 1064 in IPR2013-00111.
Sep. 18, 2013 Declaration of Nelson K Akafuah, Exhibit 1065 in IPR2013-00111.
Sep. 20, 2013 Declaration of Pinhas Ben-Tzvi, Exhibit 1066 in IPR2013-00111.
Sep. 23, 2013 Declaration of Anthony Larimer, Exhibit 1067 in IPR2013-00111.
Sep. 24, 2013 Declaration of Dr. Schmon signed, Exhibit 1068 in IPR2013-00111.
Sep. 13, 2013 Excerpted pages from EX2009 Lacovara Transcript, Exhibit 1069 in IPR2013-00111.
"How to Prepare Drawings for Patent Applications in Japan", http://www.jpo.go.jp/toiawase/faq/yokuar10.htm obtained Apr. 9, 2013, Exhibit 2001 in IPR2013-00111.
Sep. 13, 2013 Lacovara Deposition, Exhibit 2009 in IPR2013-00111.
Jan. 6, 2015 Office Action issued in Japanese Patent Application No. 2012-173256.
Dec. 2, 2014 Office Action issued in Japanese Patent Application No. 2012-177985.
Oct. 31, 2013 Search Report issued in European Application. No. 13179877.9.
Dec. 2, 2014 Office Action issued in Japanese Patent Application. 2012-192467.
Dec. 2, 2014 Office Action issued in Japanese Patent Application No. 2012-176150.
Jan. 6, 2015 Office Action issued in Japanese Patent Application No. 2012-192468.
Nov. 18, 2013 Extended European Search Report issued in European Patent Application No. 13179078.4.
Dec. 10, 2013 Extended European Search Report issued in European Patent Application No. 13182003.7.

* cited by examiner

SPRAY GUN

TECHNICAL FIELD

The present invention relates to a spray gun, in particular, a spray gun for mixing and atomizing a coating material flow and an air flow in the atmosphere.

BACKGROUND ART

For example, Japanese Unexamined Patent Application Publication No. 8-196950 (Patent Literature 1), or WO01/02099 (Patent Literature 2) disclose a coating material nozzle of a spray gun, which is formed with, for example, four air grooves disposed on a periphery of a coating material ejection opening of a tip end portion of the coating material nozzle at equal spaces. Each air groove is formed to have a cross section of, for example, a V shape, and increases in depth toward a tip of the coating material nozzle.

When a coating material is ejected from the coating material ejection opening of the coating material nozzle, a compressed air is introduced to the air grooves from a body. The air grooves are designed such that the compressed air increases in gas-liquid contact area while passing through the grooves, and then mixes with the ejected coating material by collision. As a result thereof, even if the compressed air was in a state of air flow under a low pressure, the ejected coating material can be effectively atomized toward a central portion thereof.

At the tip end portion of the coating material nozzle, an air cap is disposed to define a slit in the form of a ring shape between the tip end portion and the air cap. It is configured such that the compressed air is introduced from a side of the body behind the air cap to the slit and the air grooves of the coating material nozzle.

SUMMARY OF INVENTION

Technical Problem

In the plurality of air grooves formed on the periphery of the coating material ejection opening of the coating material nozzle along a circumferential direction, a bottom portion of each air groove is formed at the foremost end thereof so as to reach an inner peripheral surface of the coating material ejection opening. This means that the bottom portion of air grooves is configured at the foremost end thereof such that a circle connecting the bottom portions thereof is located on the inner peripheral surface of the coating material ejection opening. i.e., each air groove forms an open end thereof on an inner peripheral surface of the coating material nozzle.

As a result thereof, the compressed air, flowing through each air groove, directly penetrates in the coating material ejected from the coating material ejection opening of the coating material nozzle, which is proved to greatly resist a flow of the coating material and, as a result, excessively reduce ejection amount of the coating material.

Here, as an alternative, it is thinkable to enlarge the coating material ejection opening in diameter in order to increase the ejection amount of the coating material. Even in this case, however, since each air groove forms the open end thereof on the inner peripheral surface of the coating material nozzle, there remains a drawback such that there is a certain limit of ejection amount of the coating material cannot be increased to more than the certain extent.

The present invention has been made in view of the above described circumstances, and an object thereof is to provide a spray gun that can ensure sufficient ejection amount of coating material by preventing the air flow that penetrates in the coating material ejected from the coating material ejection opening, wherein the air flowing through the plurality of air grooves formed on a periphery of the coating material ejection opening of the coating material nozzle from hindering the ejection of the coating material.

Solution to Problem

In order to attain the above-described drawback, in accordance with a first aspect of the present invention, there is provided a s spray gun for mixing and atomizing a coating material flow and an air flow in the atmosphere, the spray gun including: a body having a gun barrel; a coating material nozzle disposed on a tip end side of the gun barrel, ejecting the coating material flow from a coating material ejection opening formed at a tip end surface thereof; and an air cap disposed on the tip end side of the gun barrel to surround a tip end portion of the coating material nozzle, the air cap defining a ring-shaped slit between an inner peripheral surface thereof and an outer peripheral surface of the tip end portion of the coating material nozzle to allow the air flow to be ejected therethrough, wherein the tip end portion of the coating material nozzle has on the tip end surface thereof a guide wall spreading from an inner periphery of the coating material ejection opening toward a tip end side of the coating material nozzle, the guide wall controlling the coating material flow ejected from the coating material ejection opening, and also has on the outer peripheral surface thereof a plurality of air grooves channeled in a longitudinal direction from a rear end side thereof in a predetermined position to the guide wall, the air grooves inducing a part of the air flow ahead of the coating material ejection opening, wherein each of the air groove grooves has a bottom portion gradually increasing in depth in the longitudinal direction, the bottom portion being located within a range of the guide wall on the tip end surface of the coating material nozzle.

In accordance with a second aspect of the present invention, according to the first aspect of the spray gun, the bottom portion of each of the air groove grooves may be located on a circle larger in diameter than diameter of an inner peripheral surface of the coating material ejection opening on the tip end surface of the coating material nozzle.

In accordance with a third aspect of the present invention, according to the first aspect of the spray gun, the guide wall may be in a conical shape and has an outer peripheral edge located inwardly from an outer peripheral edge of the tip end portion of the coating material nozzle in the range not exceeding 0.5 mm in front view.

In accordance with a fourth aspect of the present invention, according to the first aspect of the spray gun, the guide wall is in a conical shape having an opening angle in the range of 60 degrees to 150 degrees in side view.

In accordance with a fifth aspect of the present invention, according to the first aspect of the spray gun, the air groove may have a V-shaped cross section.

In accordance with a sixth aspect of the present invention, according to the fifth aspect of the spray gun, the air groove may have a curvature radius R of 0.15 mm or less at the bottom portion thereof.

In accordance with a seventh aspect of the present invention, according to the first aspect of the spray gun, the bottom portion of each of the air grooves may have a convergence angle with the bottom portion opposite thereto directing from a side of the body toward a tip end side in the range of 30 degrees to 100 degrees in side view.

In accordance with a eighth aspect of the present invention, according to the first aspect of the spray gun, the air groove may have a length in the longitudinal direction of the coating material nozzle from the rear end side thereof in the predetermined position to the foremost of the tip end surface of the coating material nozzle in the range of 1 mm to 3.5 mm.

In accordance with a ninth aspect of the present invention, according to the fifth aspect of the spray gun, the air groove may have an opening angle of the V-shaped cross section in the range of 20 degrees to 100 degrees.

In accordance with a tenth aspect of the present invention, according to the first aspect of the spray gun, the bottom portion of the air groove may be located on the guide wall of the coating material nozzle between at 0.5 mm ahead and at 0.5 mm behind, in relation to a front surface of the air cap proximate to the coating material nozzle, in the longitudinal direction of the tip end portion of the coating material nozzle.

Advantageous Effects of Invention

According to the spray gun thus configured, it is possible to ensure a sufficient ejection amount of coating material by preventing hindrance to coating material ejection from the air penetrating in the coating material ejected from the coating material ejection opening through the air grooves formed on a periphery of the coating material ejection opening of the coating material nozzle.

BRIEF DESCRIPTION OF THE DRAWINGS

FIG. 6 is a side view and a front view showing, together with the coating material nozzle, an auxiliary air hole formed on the air cap of the spray gun according to the first embodiment of the present invention.

FIG. 7 is a diagram illustrating a distribution of ejection amount of coating material with regard to opening angle of a guide wall on a tip end surface of the spray gun according to the first embodiment of the present invention.

FIG. 8 is a configuration diagram showing a principal part of a spray gun according to a second embodiment of the present invention.

DESCRIPTION OF EMBODIMENTS

Figure 1:
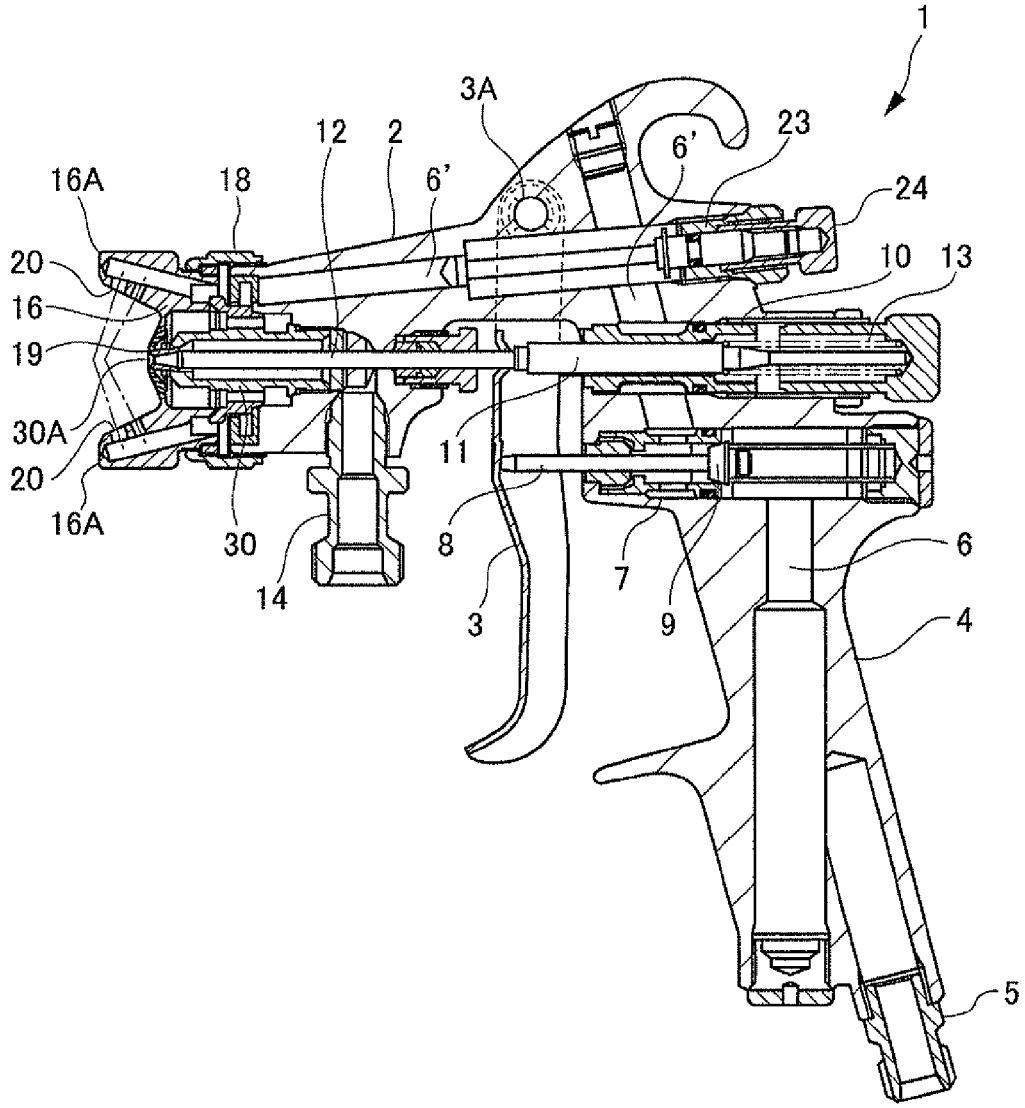
FIG. 1 is an overall configuration diagram of a spray gun according to a first embodiment of the present invention.

In the following, a detailed description will be given of embodiments of the present invention with reference to drawings. In all embodiments of the present specification, the same constituent elements have the same reference numerals.

First Embodiment

FIG. 1 is an overall configuration diagram of a spray gun 1 according to a first embodiment of the present invention;

In FIG. 1, the spray gun (body) 1 is configured to include a gun barrel 2, a trigger 3, and a grip part 4. In the spray gun 1 shown in FIG. 1, a coating material flow and an air flow are ejected from a tip end portion of the gun barrel 2 in accordance with an operation of the trigger 3, and then, mixed and atomized in the air.

In the description of constituent elements shown in FIG. 1, it should be noted that a side of the gun barrel 2 is sometimes referred to as a "tip end" or a "front end", and an opposite side to the gun barrel 2 is sometimes referred to as a "rear end" for the sake of simplicity.

In FIG. 1, a compressed air is transmitted from the grip part 4 of the spray gun 1 to an air valve part 7 via an air nipple 5 and an air passage 6, and then to the tip end portion of the gun barrel 2 via an air passage 6'. The trigger 3 is adapted to be pulled toward a side of the grip part 4 centering on a fulcrum 3A, thereby to open an air valve 9 of the air valve part 7 via a valve stem 8 so that the compressed air is transmitted to the tip end portion of the gun barrel 2. To the trigger 3 is fixed a needle valve guide 11 that recedes in a guide chamber 10 by pulling the trigger 3. To the needle valve guide 11 is fixed a needle valve 12 disposed along a central axis of the gun barrel 2. When the trigger 3 is not pulled, a coil spring 13 disposed in the guide chamber 10 is adapted to press the needle valve 12 to a seat inner surface of a coating material ejection opening 30A of a coating material nozzle 30 that is mounted to the tip end side of the gun barrel 2 so that the coating material ejection opening 30A is sealed.

When the trigger 3 is pulled, the air valve 9 is configured to be opened slightly sooner than the needle valve 12 is pulled away from the coating material ejection opening 30A of the coating material nozzle 30.

The coating material nozzle 30 is configured by a cylindrical member having a tip end portion (hereinafter, referred to as a "nozzle tip end portion 31") that includes the coating material ejection opening 30A small in diameter and a rear end portion large in diameter. The rear end portion of the coating material nozzle 30 is formed with a coating material joint 14. A coating material is supplied to the coating material nozzle 30 from, for example, a coating material reservoir (not shown) or the like that is attached to the coating material joint 14. When the needle valve 12 of the coating material nozzle 30 is open, the coating material supplied to the coating material nozzle 30 is ejected as a coating material flow from the coating material ejection opening 30A of the coating material nozzle 30.

An air cap 16 is disposed so as to surround the nozzle tip end portion 31 of the coating material nozzle 30. The air cap 16 is attached to the gun barrel 2 by means of an air cap cover 18. A slit 19 in a ring shape is formed between an inner peripheral surface of the air cap 16 and an outer peripheral surface of the nozzle tip end portion 31 of the coating material nozzle 30. The compressed air from the air passage 6' causes an air flow to be ejected from the slit 19 along a periphery of the nozzle tip end portion 31 of the coating material nozzle 30 when the air valve 9 of air valve part 7 is opened.

Figure 2:
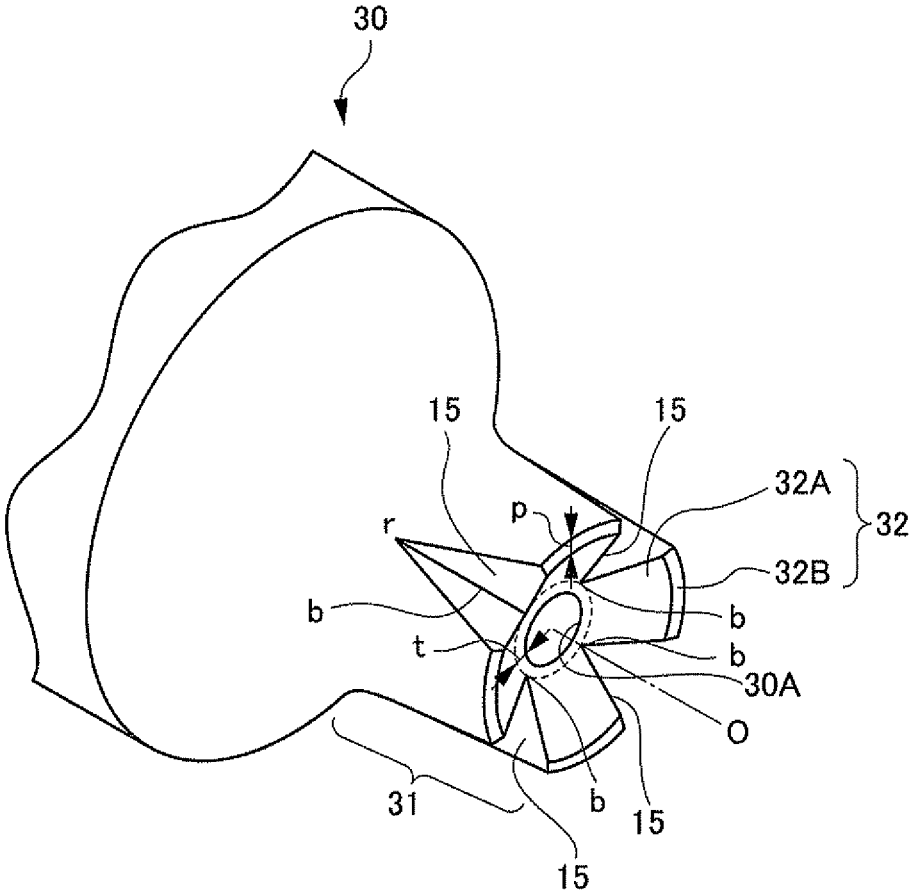
FIG. 2 is a perspective view showing a tip end portion of a coating material nozzle of the spray gun according to the first embodiment of the present invention.

As shown in FIG. 2, the nozzle tip end portion 31 of the coating material nozzle 30 includes a tip end surface 32. The coating material ejection opening 30A is formed on a central axis of the tip end surface 32. An inner diameter of the coating material ejection opening 30A is formed relatively small compared to an outer diameter of the nozzle tip end portion 31 of the coating material nozzle 30. The tip end surface 32 of the coating material nozzle 30 includes a guide wall 32A that restricts the coating material flow ejected from the coating material ejection opening 30A. The guide wall 32A is formed in a conical shape spreading from an inner periphery of the coating material ejection opening 30A toward a tip end side of the coating material nozzle 30. The guide wall 32A is configured to have an outer peripheral edge having a radial distance p inwardly from an outer peripheral edge of the nozzle tip end portion 31 of the coating material nozzle 30 in the range of 0.5 mm or less, viewed from the front. This means that the tip end surface 32 of the coating material nozzle 30 is formed with, as well as the guide wall 32A, a flat portion 32B in shape of a ring having a width of 0.5 mm or less, which is a surface perpendicular to a central axis O of the coating material nozzle 30 from the outer peripheral edge of the guide wall 32A to the outer peripheral edge of the nozzle tip end portion 31 of the coating material nozzle 30. According to the above described configuration having a radial distance not exceeding 0.5 mm from the outer peripheral edge of the nozzle tip end portion 31 of the coating material nozzle 30 to the outer peripheral edge of the guide wall 32A, it is possible to have an effect of increase in ejection amount of the coating material from the coating material ejection opening 30A and improvement in atomization, which will be described later in detail.

Figure 3:
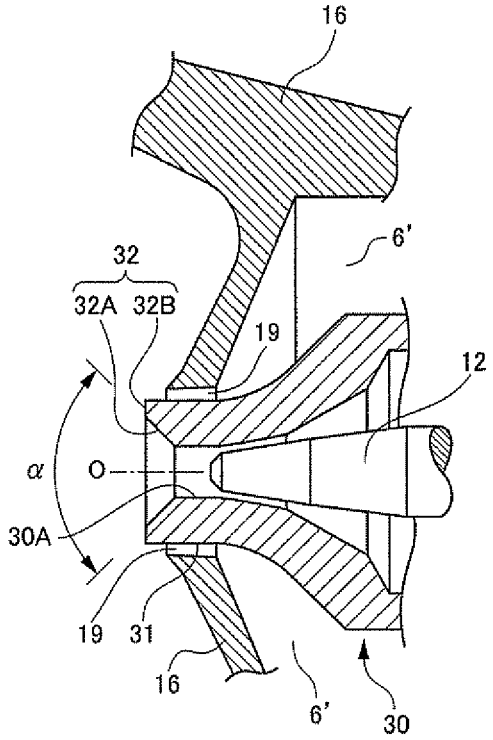
FIG. 3 is a cross sectional view (along a plane not including an air groove) showing, together with an air cap, the tip end portion of the coating material nozzle of the spray gun according to the first embodiment of the present invention.

As shown in FIG. 3, which is an enlarged cross sectional view of the nozzle tip end portion 31 of the coating material nozzle 30, the guide wall 32A in the form of a conical shape is configured to have an opening angle $\alpha$ between 60 and 150 degrees, in side view. According to the above described configuration having the opening angle of the guide wall 32A between 60 and 150 degrees, it is possible to reduce a change in surface angle to the guide wall 32A from a straight passage of the coating material ejection opening 30A of the coating material nozzle 30 and to smooth the coating material flow along the guide wall 32A, as will be described later in detail. Meanwhile, in addition to the coating material nozzle 30, the needle valve 12 and the air cap 16 are also shown in FIG. 3.

Figure 4:
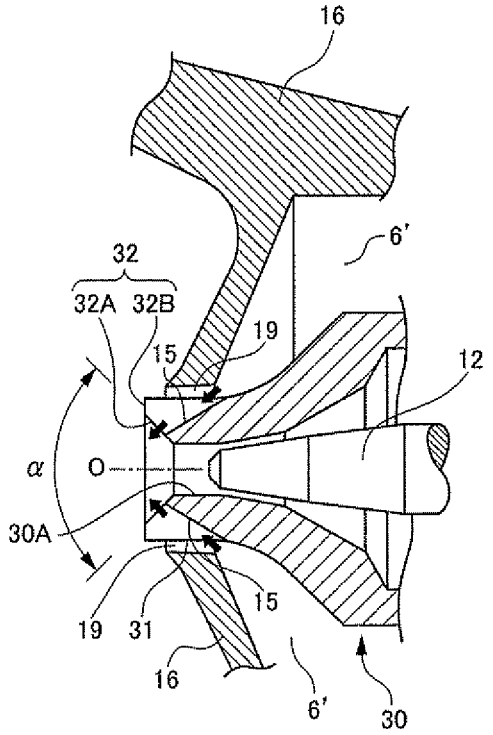
FIG. 4 is a cross sectional view (along a plane including the air groove) showing, together with the air cap, the tip end portion of the coating material nozzle of the spray gun according to the first embodiment of the present invention.

Referring back to FIG. 2, the nozzle tip end portion 31 of the coating material nozzle 30 is formed with four air grooves 15 at equal spaces in a circumferential direction on the outer peripheral surface thereof. Each air groove 15 has a cross section of, for example, a V shape. Each air groove 15 is channeled from a predetermined position (which is hereinafter sometimes referred to as a "starting point r of the air groove 15") on a rear end side (left side in FIG. 2) up to the tip end surface 32 in a longitudinal direction. Each air groove 15 has a bottom portion that increases in depth toward the tip end surface 32 of the coating material nozzle 30. The air grooves 15 are configured to guide a part of the air flow ejected through the slit 19 from the air passage 6' toward a front end side of the coating material ejection opening 30A. In FIG. 4, which is similar to FIG. 3, except for the fact that FIG. 4 shows a cross section of a part where the air groove 15 is formed, the compressed air from the air passage 6', when being ejected through the slit 19, is introduced in the air grooves 15 as shown by arrows in FIG. 4. The air flow in the air grooves 15 collides and mixes with the coating material flow from the coating material ejection opening 30A of the coating material nozzle 30 while increasing in gas-liquid contact area. As a result thereof, the compressed air, even if in a state of a low pressure air flow, can function to atomize up to a central portion of the ejected coating material.

As shown in FIG. 2, each air groove 15 is configured to have a bottom portion (denoted by b in FIG. 2) located within a range of the guide wall 32A on the tip end surface 32 of the coating material nozzle 30. More particularly, the bottom portion b of each air groove 15 is formed, on the tip end surface 32 of the coating material nozzle 30, on a circle larger in radius by, for example, t (>0) than an inner periphery of the coating material ejection opening 30A. This means that it is configured such that a case may be excluded in which the bottom portion b of each air groove 15 is located on the inner periphery of the coating material ejection opening 30A or even penetrates to an inner peripheral surface thereof. According to such configuration that the bottom portion b of each air groove 15 is located within the range of the guide wall 32A on the tip end surface of the coating material nozzle 30, it is possible to greatly reduce a resistance against the coating material flow generated by the compressed air flowing in the air grooves 15 and penetrating in the coating material flow ejected from the coating material ejection opening 30A of the coating material nozzle 30.

Figure 5:
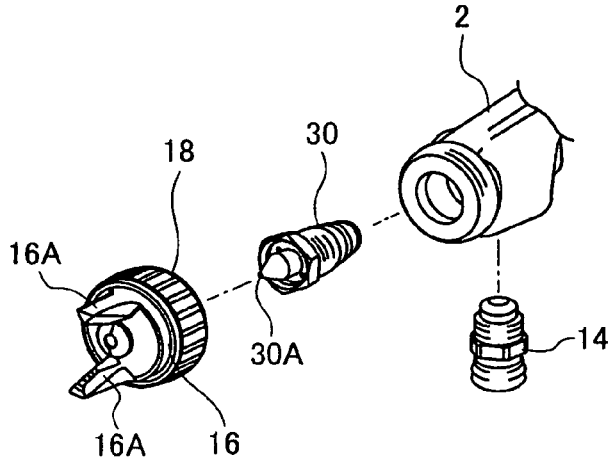
FIG. 5 is an exploded perspective view showing the coating material nozzle, the air cap, and a coating material joint that are mounted to a gun barrel of the spray gun according to the first embodiment of the present invention.

Referring back to FIG. 1, the air cap 16 is formed on a tip end surface thereof with a pair of horn portions 16A having the coating material nozzle 30 in between. FIG. 5 is a perspective view showing the air cap 16 together with a part of the gun barrel 2 in vicinity, which shows that the pair of horn portions 16A are formed so as to face toward each other and have the coating material ejection opening 30A of the coating material nozzle 30 in between. As shown in FIG. 1, each horn portion 16A has a side air hole 20 held in communication with the air passage 6'. The side air holes 20 are adapted to eject the air flow so that the ejected air flow intersects with the coating material flow from the coating material ejection opening 30A of the coating material nozzle 30. As a result of this, the coating material ejected from the coating material nozzle 30 can form an elliptical spray pattern by the aid of the compressed air ejected from the side air holes 20 of the air cap 16. The compressed air transmitted to the side air holes 20 of the air cap 16 is adjusted in flow rate by means of a spread pattern adjustment device 23 and then ejected from the side air holes 20. In the spread pattern adjustment device 23, a pattern adjustment tab 24 is adapted to be rotated so that the compressed air is adjusted in flow rate. As a result thereof, the spray pattern of the coating material ejected from the coating material nozzle 30 is adjusted in spread angle in a fan shape.

Figure 6A:
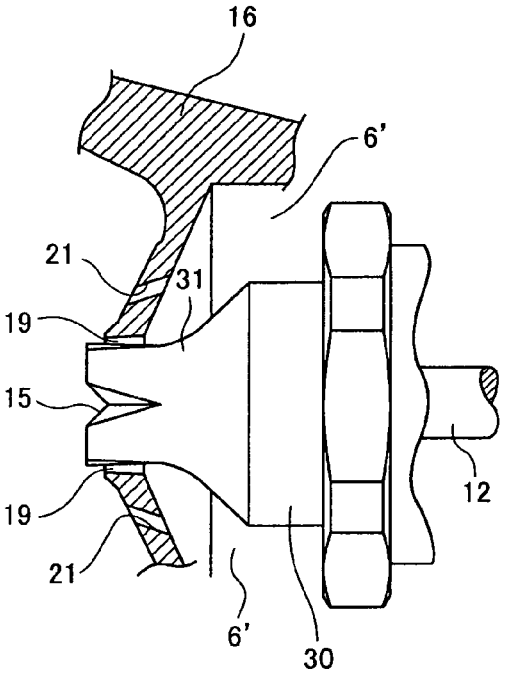
FIG. 6A is a side view of the air cap (shown in cross section) with the coating material nozzle together.
Figure 6B:
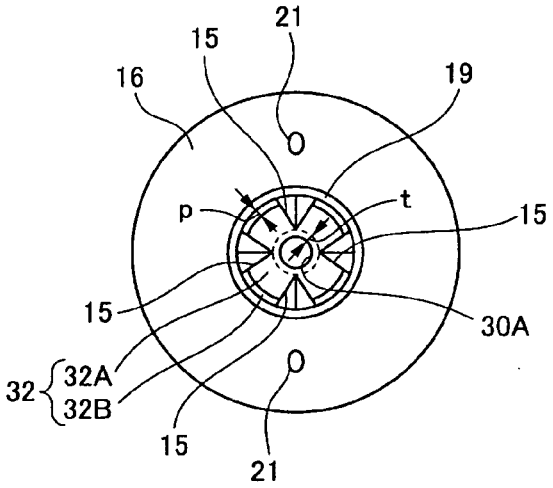
FIG. 6B is a front view of the same.

As shown in FIGS. 6A and 6B, though omitted in FIGS. 1, 3, and 4, the air cap 16 is formed in the vicinity of the nozzle tip end portion 31 of the coating material nozzle 30 having a pair of auxiliary air holes 21. The pair of auxiliary air holes 21 are disposed on the both sides of the nozzle tip end portion 31 of the coating material nozzle 30. FIG. 6A is a side view of the air cap 16 (shown in cross section) together with the coating material nozzle 30, and FIG. 6B is a front view of the same. The auxiliary air holes 21 are formed to be held in communication with the air passage 6', and the air flows from the auxiliary air holes 21 intersect with the coating material flow from the coating material ejection opening 30A of the coating material nozzle 30. The auxiliary air holes 21 are adapted to take a balance of a force of the air flow ejected from the side air holes 20 for the purpose of spray pattern formation.

According to the spray gun 1 configured as described above, it is possible to acquire the following effects.

(1) In the spray gun 1, each air groove 15 of the coating material nozzle 30 is configured to have the bottom portion b thereof within the range of the guide wall 32A at an open end thereof. As a result thereof, it is possible to avoid the air flow in the air groove 15 from directly flowing in the coating material flow ejected from the coating material ejection opening 30A. Accordingly, it is possible to greatly reduce the resistance against the coating material flow generated when the air flow in the air grooves 15 penetrates in the coating material flow ejected from the coating material ejection opening 30A. Thus, it is possible to ensure a sufficient amount of the coating material flow ejected from the coating material ejection opening 30A of the coating material nozzle 30, and to increase the amount of the coating material flow in proportion to the increase in diameter of the coating material ejection opening 30A.

(2) The spray gun 1 is configured such that the outer peripheral edge of the guide wall 32A is formed to have a radial distance p from the outer peripheral edge of the nozzle tip end portion 31 of the coating material nozzle 30 in the range of 0.5 mm or less. As a result thereof, it is possible to acquire an effect of increasing in the ejection amount of the coating material flow and improvement in atomization. It has been observed that, if the outer peripheral edge of the guide wall 32A is formed to have the radial distance p from the outer peripheral edge of the nozzle tip end portion 31 of the coating material nozzle 30 in the range of more than 0.5 mm, a turbulent flow emerges on the tip end surface 32 of the coating material nozzle 30 due to the air flow in the air grooves 15 and another air flow on the outer peripheral surface of the nozzle tip end portion 31 of the coating material nozzle 30. On the other hand, if the radial distance p between the outer peripheral edge of the guide wall 32A and the outer peripheral edge of the nozzle tip end portion 31 of the coating material nozzle 30 is configured to be 0.5 mm or less, the turbulent flow has been diminished. As a result thereof, since the air flow along the guide wall 32A becomes smooth, it is possible to increase the ejection amount of the coating material and to improve the atomization of the coating material.

Figure 7A:
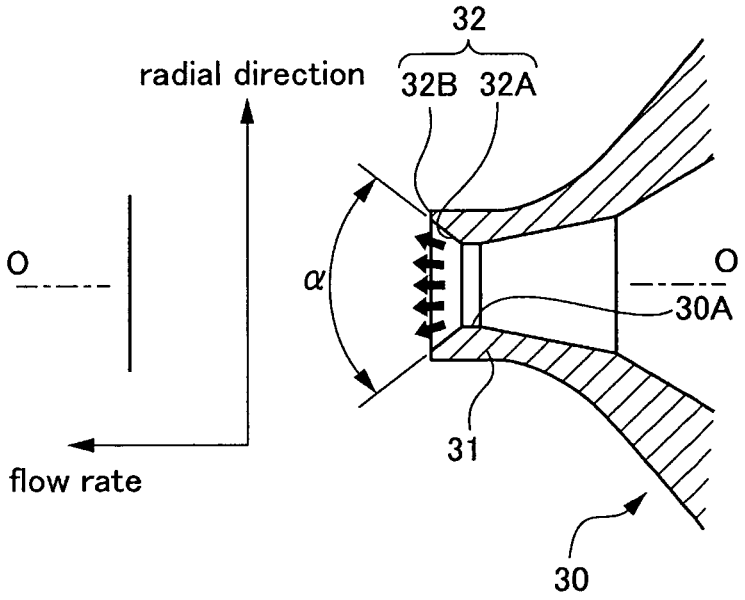
FIG. 7A shows a case in which the guide wall is formed to have an opening angle $\alpha$ between 60 and 150 degrees.

(3) In the spray gun 1, the guide wall 32A on the tip end surface 32 of the coating material nozzle 30 is configured to have the opening angle $\alpha$ between 60 and 150 degrees. As a result thereof, since the change in angle to the guide wall 32A from the straight passage of the coating material ejection opening 30A of the coating material nozzle 30 can be reduced, the coating material flow as shown by arrows in the right part of FIG. 7A can be acquired along the guide wall 32A, thereby a smooth flow can be formed. As shown in the left part of FIG. 7A, the coating material flow toward the guide wall 32A is uniform, and the coating material is uniformly ejected from the coating material ejection opening 30A. As a result thereof, it is possible to acquire an effect of increasing the ejection amount of the coating material. Here, in the left part of FIG. 7A, the vertical axis corresponds to a radial direction of the tip end surface 32 of the coating material nozzle 30, and the horizontal axis corresponds to a flow rate of the coating material.

Figure 7B:
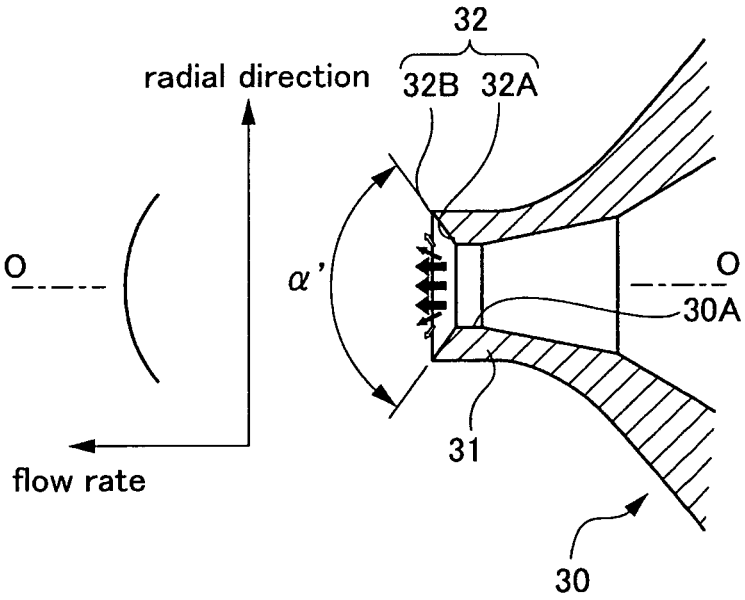
FIG. 7B shows a case in which the guide wall is formed to have an opening angle $\alpha'$ larger than 150 degrees.

On the other hand, FIG. 7B shows a distribution of ejection amount of the coating material from the coating material ejection opening 30A in a case in which the guide wall 32A is formed to have an opening angle $\alpha'$ larger than 150 degrees. As shown in the right part of FIG. 7B, the coating material ejected from the coating material ejection opening 30A does not flow smoothly along the guide wall 32A. Therefore, as shown in the left part of FIG. 7B, the coating material flow is dense in the vicinity of a central axis of the coating material ejection opening 30A but becomes sparser along the directions away from the center, thereby it is difficult to make the coating material flow uniform.

(4) Thus, by means of the spray gun 1 according to the present invention, it is possible to prevent the air flow that penetrates in the coating material ejected from the coating material ejection opening 30A, wherein the air flow flows through the plurality of air grooves 15 formed on a periphery of the coating material ejection opening 30A of the coating material nozzle 30 from hindering the ejection of the coating material. As a result thereof, it is possible to attain improvement in atomization and equalization of the coating material flow.

As above, the first embodiment is configured such that a plurality of air grooves, which are formed on a periphery of a coating material ejection opening of a coating material nozzle, are open to a tip end surface of the coating material nozzle being located on a circle larger than an inner peripheral surface of the coating material ejection opening.

According to the above described configuration, it is possible to greatly reduce resistance to a coating material flow generated when a compressed air flowing in the air grooves penetrates in the coating material ejected from the coating material ejection opening of the coating material nozzle. As a result of this, it is possible to ensure sufficient ejection amount of the coating material ejected from the coating material ejection opening of the coating material nozzle and to further increase the ejection amount in accordance with enlargement in diameter of the coating material ejection opening.

Second Embodiment

Figure 8A:
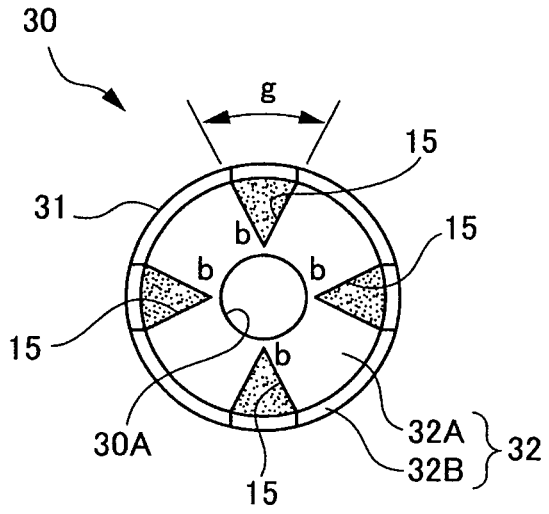
FIG. 8A is a front view of a tip end portion of a coating material nozzle.
Figure 8B:
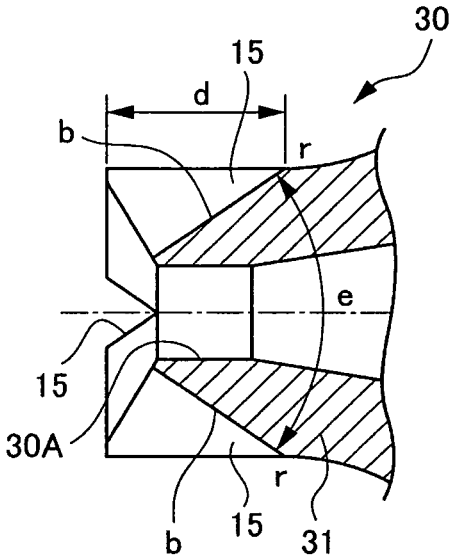
FIG. 8B is a cross sectional view thereof.

FIGS. 8A and 8B are configuration diagrams showing a principal part of a spray gun 1 according to a second embodiment of the present invention. FIG. 8A is a front view of a nozzle tip end portion 31 of a coating material nozzle 30, and FIG. 8B is a cross sectional view thereof.

Similarly as described in the first embodiment, the nozzle tip end portion 31 of the coating material nozzle 30 shown in FIGS. 8A and 8B includes on a tip end surface 32 a guide wall 32A spreading from an inner periphery of the coating material ejection opening 30A toward a tip end side of the coating material nozzle 30, and includes on an outer peripheral surface thereof a plurality of air grooves 15 channeled from a predetermined position on a rear end side thereof toward the guide wall 32A in a longitudinal direction of the coating material nozzle 30. Each air groove 15 is configured to have a bottom portion b that gradually increases in depth toward the tip end side and opens to the tip end surface 32 of the coating material nozzle 30 within a range of the guide wall 32A.

In addition to the above described configuration, in the present embodiment, each air groove 15 is configured to have an opening angle g in the range of 20 to 100 degrees and a length d (hereinafter, simply referred to as a "length d of the air groove") along a central axis of the coating material nozzle 30 from a foremost tip end surface of the coating material nozzle 30 to a starting point r of the air groove 15 in the range of 1.0 mm to 3.5 mm, and the bottom portions b of a pair of air grooves 15 facing toward each other are configured to have a convergence angle e in side view, from starting point r of the air groove 15 toward the tip end surface 32, in the range of 30 to 100 degrees.

The above described configuration has been determined for the following reasons. When the air flow enters the coating material flow after having passed through the air groove 15, the air flow causes resistance to the coating material flow, and thus reduces ejection amount of the coating material. If the resistance to the coating material increases, the reduction in ejection amount of the coating material will increase. On the other hand, if the resistance to the coating material decreases, the reduction in ejection amount of the coating material will decrease. Basically, the ejection amount of the coating material tends to decrease due to the presence of the air grooves 15.

On the other hand, the air flow passing through the air grooves 15, is mixed with the coating material flow, i.e., the air grooves 15 increase chances of gas-liquid contact, thereby enhancing mixing efficiency, and improving atomization. Thus, atomization is improved owing to the presence of the air grooves 15.

It is possible to adjust the resistance to the coating material flow and the mixing efficiency of the compressed air and the coating material by adjusting a passage area (area partitioned by intersection contours of the air grooves 15 on the guide wall 32A, i.e., area shown by dots in FIG. 8A) of the air grooves 15 on the guide wall 32A. If the resistance to the coating material flow increases, the mixing efficiency increases.

The above described resistance and mixing efficiency can be controlled by way of the position of the starting point r of each air groove 15, the convergence angle e of the facing pair of air grooves 15 toward the tip end side, and the opening angle g of each air groove 15. Since these parameters decide the passage area of the air grooves 15, it is evident that the mixing efficiency depends on the passage area.

If the length d of the air groove 15 is less than 1.0 mm, the passage area of the air groove 15 will be too small to acquire the above described effect. If the length d of the air groove 15 exceeds 3.5 mm, the air groove 15 will open to inside of the coating material ejection opening 30A. Also, if the opening angle g of the air groove 15 is less than 20 degrees, the passage area of the air groove 15 will be too small to acquire the above described effect. If the opening angle g of each air groove 15 exceeds 100 degrees, the passage area of the air groove 15 will be too large to let out the coating material. Furthermore, if the convergence angle e of the air groove 15 is less than 30 degrees, the passage area of the air groove 15 will be too small to acquire the above described effect. If the convergence angle e of the air groove 15 exceeds 100 degrees, the air groove 15 will open to inside of the coating material ejection opening 30A.

It is needless to mention that the configuration shown in the second embodiment can be employed in combination with any one of the above described first embodiment and the third to fifth embodiments, which will be described later.

Third Embodiment

Figure 9:
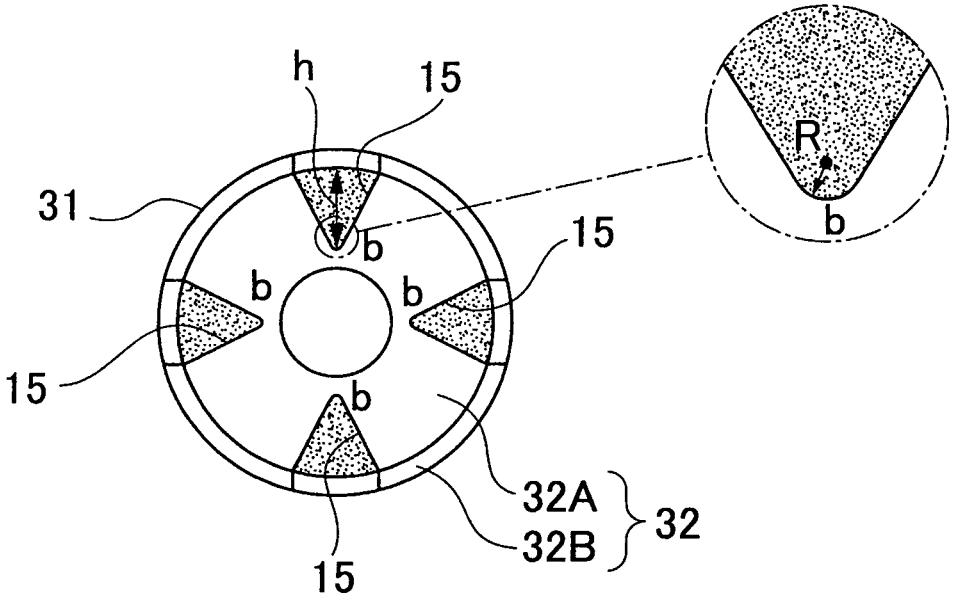
FIG. 9 is a front view of a tip end portion of a coating material nozzle showing a configuration of a principal part of a spray gun according to a third embodiment of the present invention.

FIG. 9 is a configuration diagram of a principal part of a spray gun 1 according to a third embodiment of the present invention. FIG. 9, which corresponds to FIG. 8A, is a front view of a nozzle tip end portion 31 of a coating material nozzle 30.

Similarly as described in the first embodiment, the coating material nozzle 30 includes on a tip end surface 32 of the nozzle tip end portion 31 a guide wall 32A spreading from an inner periphery of a coating material ejection opening 30A toward a tip end side of the coating material nozzle 30, and includes on an outer peripheral surface thereof a plurality of air grooves 15 channeled from a predetermined position on a rear end side thereof to the guide wall 32A in a longitudinal direction of the coating material nozzle 30. Each air groove 15 is configured to have a bottom portion b that gradually increases in depth toward the tip end side and opens to the tip end surface 32 of the coating material nozzle 30 within a range of the guide wall 32A.

In addition to the above described configuration, in the present embodiment, the bottom portion b of each air groove 15 is configured to have a curvature radius R of 0.15 mm or less.

The above described configuration has been determined for the following reasons. The air groove 15 of the nozzle tip end portion 31 of the coating material nozzle 30 is formed by, for example, a cutting tool, which has a nose R (nose radius) on a tip thereof. As a result thereof, the bottom portion b of the air groove 15 is also formed with the curvature radius R. Here, the passage area of the air groove 15 depends on the curvature radius R of the bottom portion b of the air groove 15. As the curvature radius R is decreased, a mixture of the air flow to the coating material flow proceeds more gradually, and a dispersion of the coating material flow proceeds more gradually, thereby a smooth diffusion of the coating material can be achieved. Thus, by configuring the curvature radius R to be in the range not exceeding 0.15 mm, the above described effect can be acquired. On the contrary, if the curvature radius R exceeds 0.15 mm, the mixture of the air flow to the coating material flow proceeds rapidly, and the diffusion of the coating material proceeds rapidly, causing a drawback of adherence of the coating material to the air cap 16.

It is needless to mention that the configuration shown in the third embodiment can be employed in combination with any one of the above described first and second embodiments and the fourth and fifth embodiments, which will be described later.

Fourth Embodiment

Figure 10:
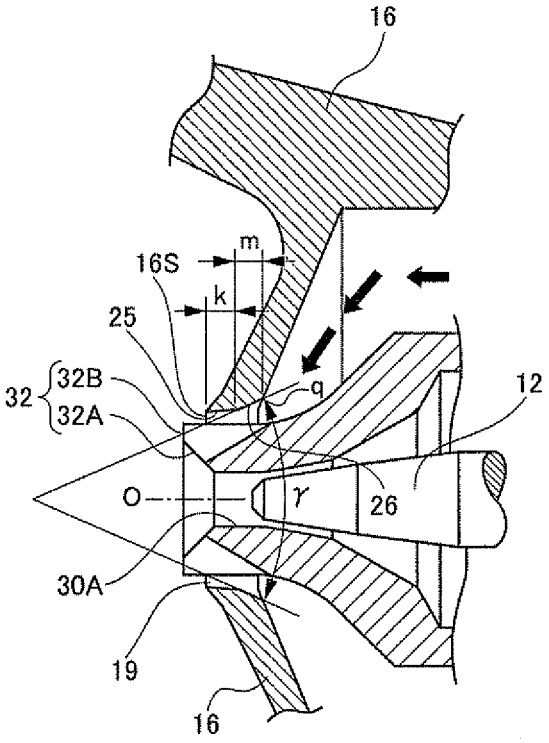
FIG. 10 is a cross sectional view of a tip end portion of a coating material nozzle and an air cap disposed surrounding the tip end portion showing a configuration of a principal part of a spray gun according to a fourth embodiment of the present invention.

FIG. 10 is a configuration diagram showing a principal part of a spray gun (body) 1 according to a fourth embodiment. FIG. 10 is a cross sectional view of a nozzle tip end portion 31 of a coating material nozzle 30 and an air cap 16 disposed to surround the nozzle tip end portion 31.

Similarly as described in the first embodiment, the coating material nozzle 30 includes on a tip end surface 32 of the nozzle tip end portion 31 a guide wall 32A spreading from an inner periphery of a coating material ejection opening 30A toward a tip end side of the coating material nozzle 30, and includes on an outer peripheral surface thereof a plurality of air grooves 15 channeled from a predetermined position on a rear end side thereof to the guide wall 32A in a longitudinal direction of the coating material nozzle 30. Each air groove 15 is configured to have a bottom portion b that increases in depth toward the tip end side and opens to the tip end surface 32 of the coating material nozzle 30 within a range of the guide wall 32A.

In addition to the above described configuration, in the present embodiment, the air cap 16 includes on an inner peripheral surface thereof a parallel surface 25 that faces toward, and disposed in parallel to, an outer peripheral surface of the nozzle tip end portion 31 of the coating material nozzle 30, and a tapered surface 26 that spreads in conical shape from a rear end of the parallel surface 25. The parallel surface 25 has, in side view, a width k along a central axis of the air cap 16 in the range of between 0.3 mm and 1.0 mm. The tapered surface 26 has, in side view, a width m along the central axis of the air cap 16 in the range of between 0.1 mm and 0.5 mm, and an opening angle γ toward the rear end side of the coating material nozzle 30 in the range of between 10 and 90 degrees.

The above described configuration has been determined for the following reasons. If an air flow entering the air grooves 15 is sufficiently strong, the air flow in the air grooves 15 will be smooth, and efficiency of collision and mixture of the air flow with a coating material flow will be enhanced. As a result thereof, the coating material flow will be well dispersed and equalized.

If a starting point r of the air groove 15 is located closer with respect to the body than a rear end q of a slit 19 in a ring shape formed between the air cap 16 and the nozzle tip end portion 31 of the coating material nozzle 30. The force of air flow entering into the air grooves 15 is increased, as the distance between the starting point r of the air groove 15 and the rear end q of a slit 19 along the longitudinal direction is increased. This is because the air flow, which has entered the air cap 16, directly flowing through the air grooves 15, thereby increases the force of the air flow through the air grooves 15.

On the other hand, if the starting point r of the air groove 15 is set at a position anterior to the rear end q of the slit 19, the air flow will not directly enter the air grooves 15. Therefore, the air flow flowing through the air grooves 15 will be weakened, and efficiency of mixture with the coating material will be decreased.

As described above, the inner peripheral surface of the air cap 16 is formed with the parallel surface 25 facing toward and disposed parallel to the outer peripheral surface of the nozzle tip end portion 31 of the coating material nozzle 30, as well as the tapered surface 26 spreading in conical shape from the rear end of the parallel surface 25. The parallel surface 25 is adapted to maintain straight the air flow in a gap with the coating material nozzle 30, thereby ensure ejection amount of the coating material. The tapered surface 26 is adapted to smooth the air flow to the parallel surface 25 and to adjust the strength of the air flow entering the air grooves 15 by adjusting the width m of the tapered surface 26.

If the width k of the parallel surface 25 along the central axis of the air cap 16 is less than 0.3 mm, the air flow cannot be maintained straight, and the ejection amount of the coating material will decrease. On the other hand, if the width k of the parallel surface 25 along the central axis of the air cap 16 exceeds 1.0 mm, the parallel surface 25 of the air cap 16 will be disposed close to the starting point r, and a passage area of the air flow will be narrow. As a result thereof, the amount of the air flow flowing through the air grooves 15 is restricted, which causes decrease in atomization and ejection amount of the coating material. Therefore, the width k of the parallel surface 25 along the central axis of the air cap 16 is preferably set in the range of 0.3 mm to 1.0 mm.

With regard to the tapered surface 26, as the width m thereof along the central axis of the air cap 16 is decreased, the force of the air flow entering the air grooves 15 is increased, which will improve the dispersion of the coating material and make the flow of the coating material uniform, thereby changing the spray pattern into a flat type. However, if the width m is less than 0.1 mm, the force of the air flow entering the air grooves 15 will become excessively strong, and the ejection amount of the coating material will decrease. On the other hand, if the width m of the tapered surface 26 along the central axis of the air cap 16 exceeds 0.5 mm, the force of the air flow entering the air grooves 15 will become too weak, and the coating material flow will be dense in a center portion thereof, which is called "center thick". Therefore, the width m of the tapered surface 26 along the central axis of the air cap 16 is preferably set in the range of 0.1 mm to 0.5 mm.

Although the tapered surface 26 shown in FIG. 10 is a single tapered surface, the present invention is no limitation thereto, and a multi tapered surface may be employed as the tapered surface 26, in order to make the air flow smoother, and to stabilize the spray pattern of the coating material to be in a flat shape. Furthermore, the tapered surface 26 may be configured to have a curved surface along the central axis of the air cap 16, which will acquire a similar effect of smoothing the air flow.

It is needless to mention that the configuration shown in the fourth embodiment can be employed in combination with any one of the above described first to third embodiments and the fifth embodiment, which will be described later.

Fifth Embodiment

Figure 11:
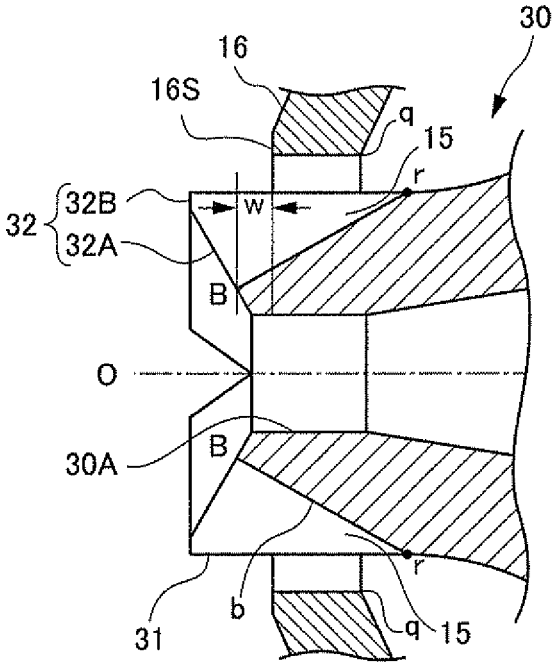
FIG. 11 is a cross sectional view of a tip end portion of a coating material nozzle along with an air cap showing a configuration of a principal part of a spray gun according to a fifth embodiment of the present invention.

FIG. 11 is a configuration diagram of a principal part of a spray gun 1 according to a fifth embodiment. FIG. 11 is a cross sectional view of a nozzle tip end portion 31 of a coating material nozzle 30 along with an air cap 16.

The coating material nozzle 30 and the air cap 16 are configured similarly to, for example, the configuration shown in the first embodiment.

Here, a distance W is defined as a distance between a front end surface 16S proximate to the coating material nozzle 30, of the air cap 16, and a bottom (denoted by B in FIG. 11) of an open end of an air groove 15 on a guide wall 32A of the coating material nozzle 30. The bottom B is configured to be located between at 0.5 mm ahead and at 0.5 mm behind in relation to the front end surface 16S along a longitudinal direction of the nozzle tip end portion 31 of the coating material nozzle 30.

In the example of FIG. 11, the bottom B of the open end of the air groove 15 on the guide wall 32A of the coating material nozzle 30 is located at 0.5 mm ahead of the front end surface 16S of the air cap 16.

According to the spray gun 1 thus configured, it is possible to avoid adherence of coating material to the air cap 16 as well as to improve dispersion and atomization of the coating material. If the coating material nozzle 30 is configured to have the bottom B of the open end of the air groove 15 on the guide wall 32A located backward along the longitudinal direction of the nozzle tip end portion 31 in relation to the front end surface 16S proximate to the coating material nozzle 30 of the air cap 16, an air flow flowing in a coating material flow will increase, and the dispersion and atomization of the coating material will be improved.

However, in this case, since the coating material flow and the air flow are mixed in the vicinity of the air cap 16, it is difficult to avoid the air cap 16 from adhering to the coating material diffused from the coating material nozzle 30. Therefore, if the coating material nozzle 30 is configured to have the bottom B of the open end of the air groove 15 on the guide wall 32A located forward in relation to the front end surface 16S of the air cap 16 along the longitudinal direction of the nozzle tip end portion 31, it is possible to avoid the coating material diffused from the coating material nozzle 30, from adhering to the air cap 16.

In view of the above, in the present embodiment, it is configured such that the bottom B of the open end of the air groove 15 on the guide wall 32A of the coating material nozzle 30 is located between at 0.5 mm ahead and at 0.5 mm behind in relation to the front end surface 16S of the air cap 16 along the longitudinal direction of the nozzle tip end portion 31 of the coating material nozzle 30, thereby it is possible to avoid the coating material diffused from the coating material nozzle 30, from adhering to the air cap 16 as well as to improve the dispersion and atomization of the coating material.

It is needless to mention that the configuration shown in the fifth embodiment can be employed in combination with any one of the above described first to fourth embodiments.

It should be noted that the present invention is not limited to the scope described in the embodiments described above. It will be clear to those skilled in the art that modifications and improvements may be made to the embodiments described above. It should be noted that such modifications and improvements are included in the scope of the present invention.

REFERENCE SINGS LIST

1 spray gun (body)
2 gun barrel
3 trigger
3A fulcrum
4 grip part
5 air nipple
6, 6' air passage
7 air valve part
8 valve stem
9 air valve
10 guide chamber
11 needle valve guide
12 needle valve
13 coil spring
14 coating material joint
15 air groove
16 air cap
16A horn portion
16S tip end surface (of the air cap)
18 air cap cover
19 slit (in a ring shape)
20 side air hole
21 auxiliary air hole
23 spread pattern adjustment device
24 pattern adjustment tab
25 parallel surface
26 tapered surface
30 coating material nozzle
30A coating material ejection opening
31 nozzle tip end portion
32 tip end surface (of the coating material nozzle)
32A guide wall
32B flat portion

CITATION LIST

Patent Literature

Patent Literature 1: Japanese Unexamined Patent Application Publication No. 8-196950
Patent Literature 2: WO01/02099

The invention claimed is:

1. A spray gun for mixing and atomizing a coating material flow and an air flow in the atmosphere, the spray gun comprising:

a body having a gun barrel;

a coating material nozzle disposed on a tip end side of the gun barrel, the coating material nozzle ejecting the coating material flow from a coating material ejection opening formed at a tip end surface thereof; and an air cap disposed on the tip end side of the gun barrel to surround a tip end portion of the coating material nozzle, the air cap defining a ring-shaped slit between an inner peripheral surface thereof and an outer peripheral surface of the tip end portion of the coating material nozzle to allow the air flow to be ejected therethrough, wherein the tip end portion of the coating material nozzle has on the tip end surface thereof a guide wall gradually enlarged in diamter outwardly from an inner periphery of the coating material ejection opening toward a tip end side of the coating material nozzle, the guide wall controlling the coating material flow ejected from the coating material ejection opening, and also has on the outer peripheral surface thereof a plurality of air grooves channeled in a longitudinal direction from a rear end side thereof in a predetermined position to the guide wall, the plurality of air grooves inducing a part of the air flow ahead of the coating material ejection opening, wherein each of the plurality of air grooves has a bottom portion gradually increasing in depth in the longitudinal direction, the bottom portion being located within a range of the guide wall on the tip end surface of the coating material nozzle, wherein the bottom portion of each of the plurality of air grooves is located on a circle larger in diameter than a diameter of an inner peripheral surface of the coating material ejection opening on the tip end surface of the coating material nozzle, and wherein the guide wall is conical.

2. The spray gun according to claim 1, wherein the conical guide wall has an outer peripheral edge located inwardly from an outer peripheral edge of the tip end portion of the coating material nozzle in a range not exceeding 0.5 mm in front view.

3. The spray gun according to claim 1, wherein the conical guide wall has an opening angle in a range of 60 degrees to 150 degrees in side view.

4. The spray gun according to claim 1, wherein at least one of the plurality of air grooves has a V-shaped cross section.

5. The spray gun according to claim 4, wherein at least one of the plurality of air grooves has an opening angle of the V-shaped cross section in a range of 20 degrees to 100 degrees.

6. The spray gun according to claim 1, wherein at least one of the plurality of air grooves has a curvature radius R of 0.15 mm or less at the bottom portion thereof.

7. The spray gun according to claim 1, wherein the bottom portion of each of the plurality of air grooves has a convergence angle with the bottom portion opposite thereto directing from a side of the body toward a tip end side in a range of 30 degrees to 100 degrees in side view.

8. The spray gun according to claim 1, wherein at least one of the plurality of air grooves has a length in the longitudinal direction of the coating material nozzle from the rear end side thereof in the predetermined position to the foremost of the tip end surface of the coating material nozzle in a range of 1 mm to 3.5 mm.

9. The spray gun according to claim 1, wherein the bottom portion of at least one of the plurality of air grooves is located on the guide wall of the coating material nozzle between at 0.5 mm ahead and at 0.5 mm behind, in relation to a front surface of the air cap proximate to the coating material nozzle, in the longitudinal direction of the tip end portion of the coating material nozzle.

* * * * *